US007156352B2

(12) United States Patent
Cudney

(10) Patent No.: US 7,156,352 B2
(45) Date of Patent: Jan. 2, 2007

(54) ACCESSORY CONTAINER ATTACHMENT FOR A PAINT CAN

(76) Inventor: Dennis Cudney, 189 Ramsdell Ave., Buffalo, NY (US) 14210

( * ) Notice: Subject to any disclaimer, the term of this patent is extended or adjusted under 35 U.S.C. 154(b) by 79 days.

(21) Appl. No.: 11/029,928

(22) Filed: Jan. 5, 2005

(65) Prior Publication Data

US 2005/0145764 A1 Jul. 7, 2005

Related U.S. Application Data

(60) Provisional application No. 60/534,341, filed on Jan. 5, 2004.

(51) Int. Cl.
*E06C 7/14* (2006.01)

(52) U.S. Cl. ..... 248/211

(58) Field of Classification Search ..... 248/211, 248/210, 238, 213.2, 230.1, 219.4; 206/373; 220/735; 182/129; 211/10, 107, 133.6
See application file for complete search history.

(56) References Cited

U.S. PATENT DOCUMENTS 3,980,264 A 9/1976 Tomasik
5,322,183 A * 6/1994 Strachan ..... 220/697
5,482,095 A * 1/1996 de Chollet ..... 141/380
5,622,342 A * 4/1997 Mills ..... 248/126
5,816,363 A 10/1998 Searcy
5,971,200 A * 10/1999 Reynolds ..... 220/694
6,065,722 A * 5/2000 LeVasseur et al. ..... 248/230.8
6,435,304 B1 8/2002 Stierle
6,446,829 B1 * 9/2002 Malvasio et al. ..... 220/697
6,536,590 B1 3/2003 Godshaw et al.

* cited by examiner

*Primary Examiner*—Ramon O Ramirez
(74) *Attorney, Agent, or Firm*—Vincent G. LoTempio

(57) ABSTRACT

A accessory container attachment for a paint can comprising an inexpensive plastic paint can caddy having a substantially rectangular container housing with multi-compartments adapted to fit securely to a paint can. The substantially rectangular container housing having one side thereof curved to conform to the curvature of the paint can, and attached thereto is a detachable strap member used in combination with a slot extending downwardly in the curved side for detachably securing the housing to a paint can. A plurality of various-shaped extrusions may be molded into compartments on the side walls of the housing to hold accessories such as a paintbrush, paint can top, small and tools, measuring tape and the like.

15 Claims, 6 Drawing Sheets

ACCESSORY CONTAINER ATTACHMENT FOR A PAINT CAN

This application claims priority of U.S. Provisional Patent Application 60/534,341, filed on Jan. 5, 2004, titled: Paint Can Caddy.

BACKGROUND OF THE INVENTION

The present invention relates to accessory container attachment for a paint can and more particularly pertains to a paint can caddy which may be used in conjunction with a conventional paint bucket with a handle.

DESCRIPTION OF THE RELATED ART

There are numerous devices known in the art that are adapted to store painting tools or the like. None of the prior art teaches a device that efficiently detachably connects to a paint can. Painting can be a messy task that is difficult and labor-intensive. It would be a benefit, therefore, to have a paint can attachment that allowed a user to carry a can of paint along with additional tools and related paraphernalia to aid in the painting job. In addition, because it is often difficult to find a place to hold a wet paintbrush during breaks or when a different sized brush is required it would be a further benefit if the paint can caddy included a brush holder for holding a wet paintbrush. Also, because a painter may require more than one brush when painting, it would be further desirable to have a painting caddy that included multiple brush holders. In addition if would be convenient if the painter had a place to store the top of the paint can during the painting procedure.

Many prior attempts have been made to alleviate the problems associated with paint can caddies in an effort find a suitable connection mechanism. But no paint can caddies have eliminated the above noted problems.

For example, U.S. Pat. No. 3,980,264 the Tomasik relates to a paint can caddy for use with a ladder. The holder includes a horizontal base for supporting a paint can, a vertical member and a trip can for paint to collect any spillage. This device is limited in that it does not have a multicompartment housing and it does not connect directly to a can of paint.

The U.S. Pat. No. 5,816,363 to Searcy shows a device for supporting a paint container on a ladder using an arcuate portion consisting of or round loop of heavy wire or rod material formed in a curve to define the opening that supports the paint container. This device is also limited in that it can only support a paint can to a ladder but it cannot provide a place to accommodate a brush or other tools.

The U.S. Pat. No. 6,435,304 to Stierle shows a tool bag for use with scaffolding and ladders having rails and rungs. The bag is constructed of soft fabric. The bag is fastened a rung of the ladder. This device is incapable of connecting to a can of paint and is cumbersome, inefficient and difficult to manufacture.

U.S. Pat. No. 6,536,590 Godshaw et al discloses a bucket and tool holder having a semi cylindrical shaped bucket that fits into a cloth container that has pockets and brackets therein. The canvas bag has adjustable bottom straps and a hook for attachments to the rung of a ladder. However this device does not allow for a housing with compartments to carry tools and the like in association with a paint can.

Accordingly, there is a need in the art for a accessory container attachment for a paint can that overcomes the above drawbacks.

SUMMARY OF THE INVENTION

An accessory container attachment for a paint can comprising an inexpensive plastic paint can caddy having a substantially rectangular container with multi-compartments adapted to fit securely to a paint can. The substantially rectangular container having one side thereof curved to conform to the curvature of the paint can, and attached thereto is a detachable strap member used in combination with a slot extending downwardly in the curved side for detachably securing the container to a paint can.

A general object of the present invention is to provide a paint can attachment and paint tool storage device with at least one compartment.

Another general object of the present invention is to provide an accessory container attachment for a paint can that has multiple compartments and surrounds one half of can or bucket.

Still another general object of the present invention is to provide an accessory container attachment for a paint can that has multiple compartments that surround an entire bucket.

Another object of the present invention is to provide an accessory container attachment for a paint can adapted to hold securely to paint cans of various sizes.

Still another object of the present invention is to provide an accessory container attachment for a paint can which may be easily and efficiently manufactured and marketed.

Still a further object of the present invention is to provide an accessory container attachment for a paint can which can be positioned in a non-slip relationship to the side of a paint bucket.

Still another object of the present invention is to provide an accessory container attachment for a paint can which can hold more than one brush and a paint can top or lid.

Still another further object of the present invention is to provide an accessory container attachment for a paint can that is easily attachable and detachable to and from a standard sized bucket.

The above and other objects are accomplished in accordance with the present invention comprising an inexpensive plastic paint can caddy having a multi-compartment housing adapted to fit securely to a paint can. The side panel is a molded arcuate panel which can securely fit to a can of paint and attached thereto is a detachable strap member for holding the housing to a paint can. A plurality of various-shaped extrusions may be molded into compartments on the side walls of the housing to hold accessories such as a paintbrush, paint can top, small and tools, measuring tape and the like.

These and other objects, features and advantages of the present invention will become readily apparent to those having ordinary skill in the art upon a reading of the following detailed description in view of the appended drawings.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 3:
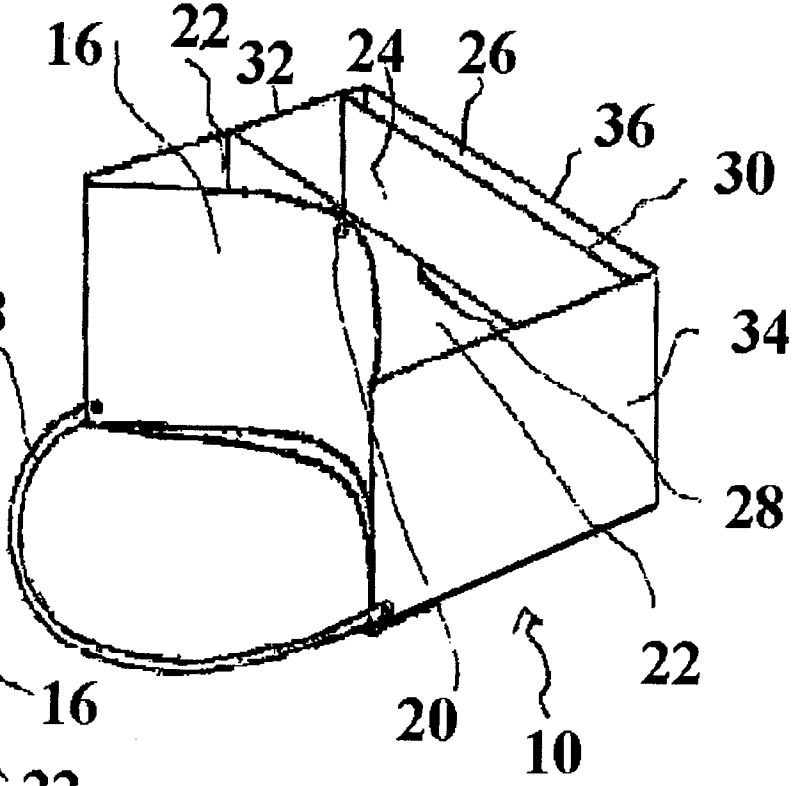
FIG. 3 is a perspective view of an accessory container attachment for a paint can in accordance with the present invention not attached to a paint can.

This application claims priority of U.S. Provisional Patent Application 60/534,341, filed on Jan. 5, 2004, titled: Paint Can Caddy.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

The present invention relates to a multi-compartment accessory container attachment for a paint can (removably attachable to the outer portion of a paint can). One embodiment of the instant invention comprises a multi-compartment container or housing that encircles a paint can. The paint can is inserted into the circular opening of the container and the compartments are situated at the ends of the handle of the can. The circular opening has interior walls with slots situated to accept the handle of the can to detachably secure the container to the can. Another embodiment has a container that is attached to one side of the can and is securable to the outside of a can with an elastic strap or other similar attachment means. This device allows a user to carry a paint can having a quantity of paint and multiple tools and utensils inside the compartments of the housing.

Figure 1:
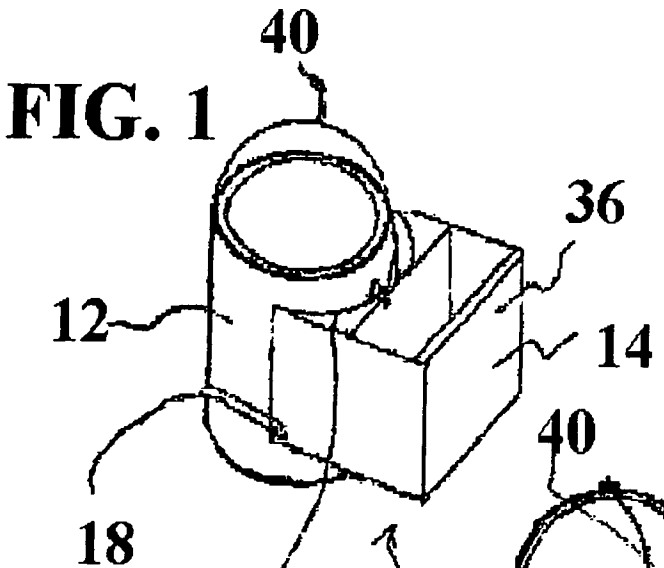
FIG. 1 is a front perspective view of an accessory container attachment for a paint can in accordance with the present invention attached to a paint can.

Adverting now to the drawings, with reference to FIG. 1, a preferred embodiment of the accessory container attachment for a paint can (or commonly known as a paint can caddy device) of the present invention is indicated generally by numeral 10. In use, the accessory container attachment for a paint can is connected to a standard paint can 12. It will be noted that the basic paint can caddy of the present invention 10, comprises a container 14 of generally rectangular configuration with an arcuate side 16 thereof adapted to approximately conform to the curvature of a cylindrical paint can 12. Extending around paint can 12 is a flexible strap 18 extending outwardly from the sides of container 14. Means for attachment 20 is a cut out positioned at the top center of arcuate side 16 and is operatively arranged to detachably connect to paint can handle 40 and is used in conjunction with flexible strap 18 to detachably secure the device to a paint can.

In a preferred embodiment, the accessory container attachment for a paint can having a handle is made of lightweight flexible plastic, although any other material that will provide support for a paint can and the contents of the caddy's compartments, or the like can also be used, such as glass, metal, wood, or rubber.

Figure 2:
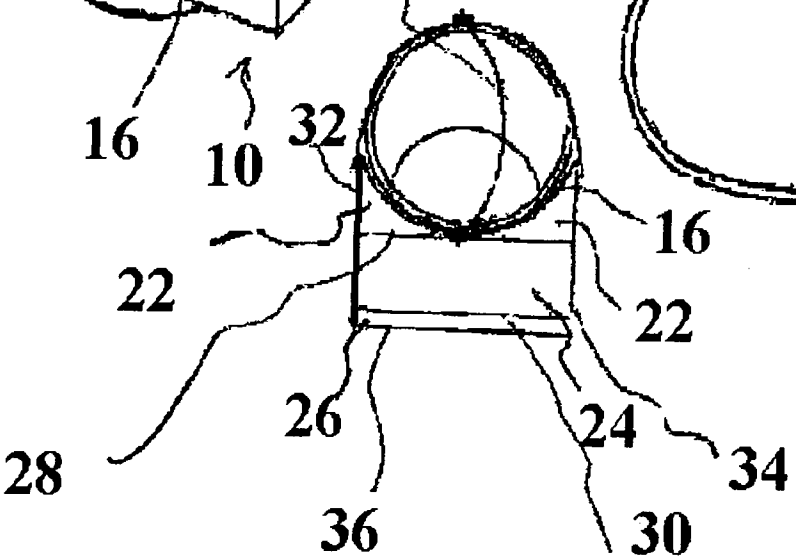
FIG. 2 is a top view of accessory container attachment for a paint can in accordance with the present invention attached to a paint can.

In a preferred embodiment container 14 is configured with at least one compartment. As seen in FIG. 2 container 14 is divided into four compartments. Corresponding triangular compartments 22 are formed by arcuate side 16 and first inner wall 28. Rectangular compartment 24 is defined by first inner wall 28, second inner wall 30, first side wall 32, and second side wall 34. Lid compartment 26 is defined by second inner wall 30, end wall 36. During a painting procedure the lid of the paint can is cumbersome and is usually left on the floor and gets in the way of the painter. The compartment 26 is arranged to accept the standard lid of a paint can. The compartments hold various tools, for example a paintbrush, paint can top, stirring stick, cutting knife, scraper, putty knife, pencils, tape measure and the like. When a person is painting with a paint can it is often necessary to use other tools during the course the job. The multi-compartments of this paint can caddy device allows the painter to put a wet brush in an empty compartment while using the tool obtained from another compartment. It should be appreciated that the compartments can comprise any combination of sides and walls configured and constructed to thus form multiple compartments (such as circular, triangular, or additional rectangular compartments, or different combinations of the same, for example).

Although container 14 of the preferred embodiment, as shown in the drawings, is constructed from separate components, (arcuate side 16, first inner wall 28, second inner wall 30, first side 32, second side 34 and end wall 36 etc.) it should be understood, that other constructions may be used without departing from the invention. For example, container 14 may be formed in a unitary construction as a single molded unit.

FIG. 3 is perspective view of a paint can caddy in accordance with the present invention not attached to a paint can. Flexible strap 18 is attached at one end proximate the bottom of first side wall 32 and at the other end proximate to bottom second side wall 34. This positioning of the strap allows the arcuate side to be held securely against the arcuate side of a standard paint can.

Figure 4:
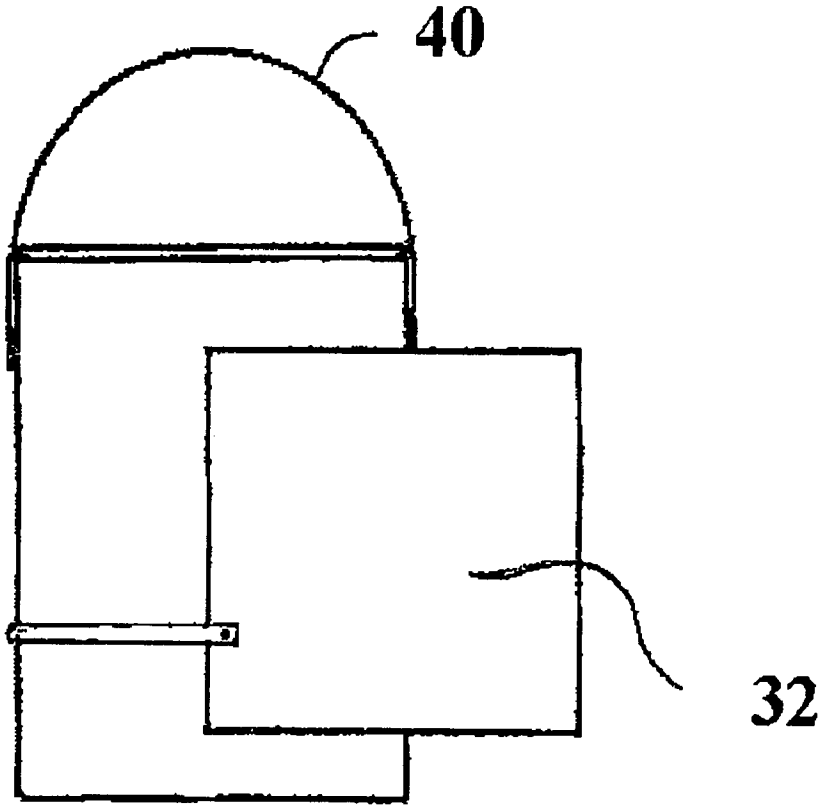
FIG. 4 is a side view of the present invention attached to a paint can.

FIG. 4 is a side view of the present invention attached to a paint can. It should be appreciated be this device is positioned on a paint can so that first side 32 is parallel to paint can handle 40 when the handle is positioned perpendicular to the top of the can (as shown in FIG. 4). When a can is held by the handle the can will pivot on an axis to maintain a balance. If the weight of the paint can caddy is not centered with handle 40 the can will be held out of balance. A paint can caddy secured to the outside of a can, centered at the connection point of handle 40, will maintain the equilibrium of the can.

Figure 5:
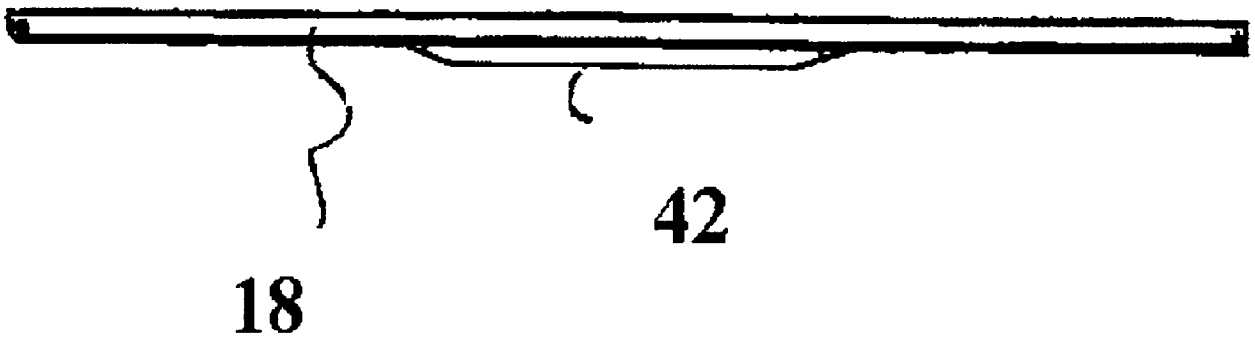
FIG. 5 is a front view of the attachment strap with a handle grip of a preferred embodiment of the present invention.

FIG. 5 is a front view of a preferred embodiment of flexible strap 18 with grip 42 of the present invention. This grip allows the painter to maintain a grasp of the paint can from the strap. The grip is approximately 4 inches long and ¼ inch wide. In addition, the preferred dimensions of the strap for a standard can of paint is approximately 10 inches long and ⅜ of on inch wide. However it should be appreciated by one skilled in the art that the dimensions are for general illustration only, and other dimensions and constructions are possible. The strap is generally configured of a durable elastic material, but can be made of many different materials for example plastic, metal, rubber, string, rope and the like.

Figure 6:
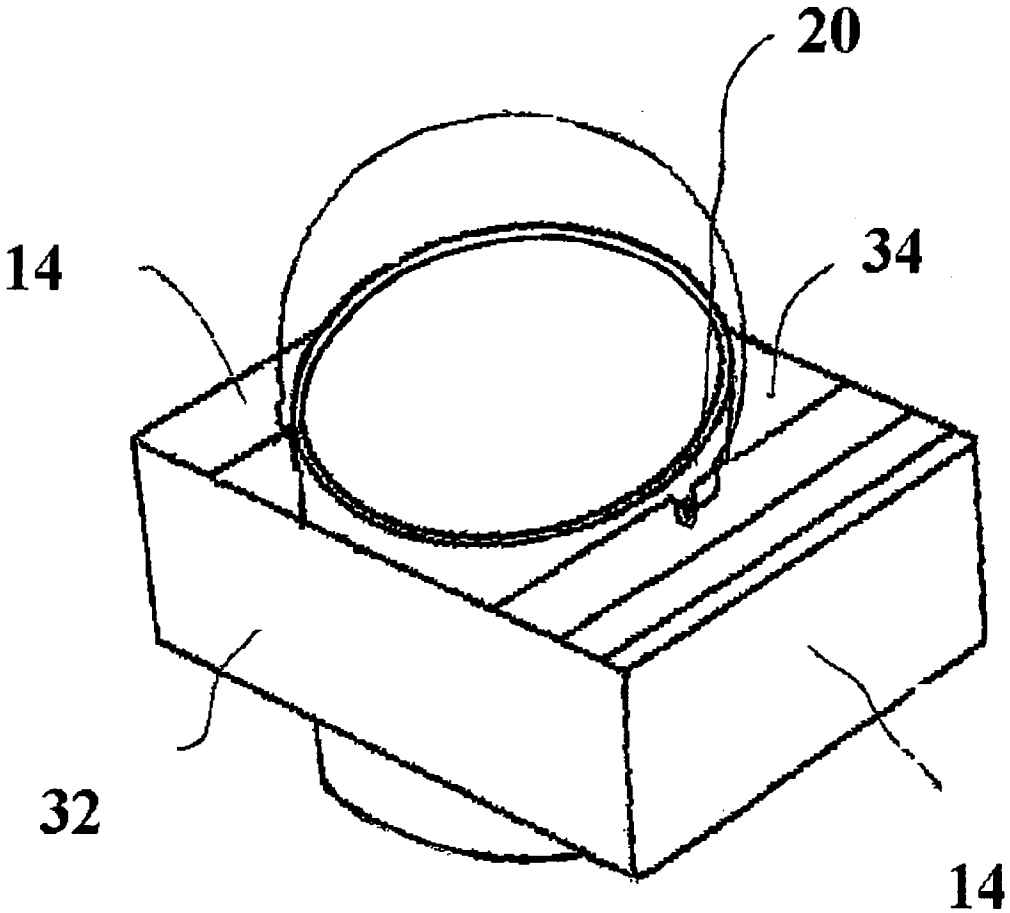
FIG. 6 is perspective view another embodiment of the accessory container attachment for a paint can of the present invention that encircles the entire paint can.

FIG. 6 is perspective view another embodiment of the paint caddy of the present invention. In this embodiment the device encircles the entire paint can. Container 14 and its mirror image are positioned at both ends of the can handle. In this embodiment the container 14 of the paint can caddy as shown in FIGS. 1–4 shares first side wall 32 and second side wall 34 with a second container 14. The sides extend along the side of the can. Means for attachment slot 20 is a cut out which is operatively arranged to accept the handle of the can. The arcuate inner walls are made of a flexible material that surrounds the paint can and holds the device securely.

Figure 7:
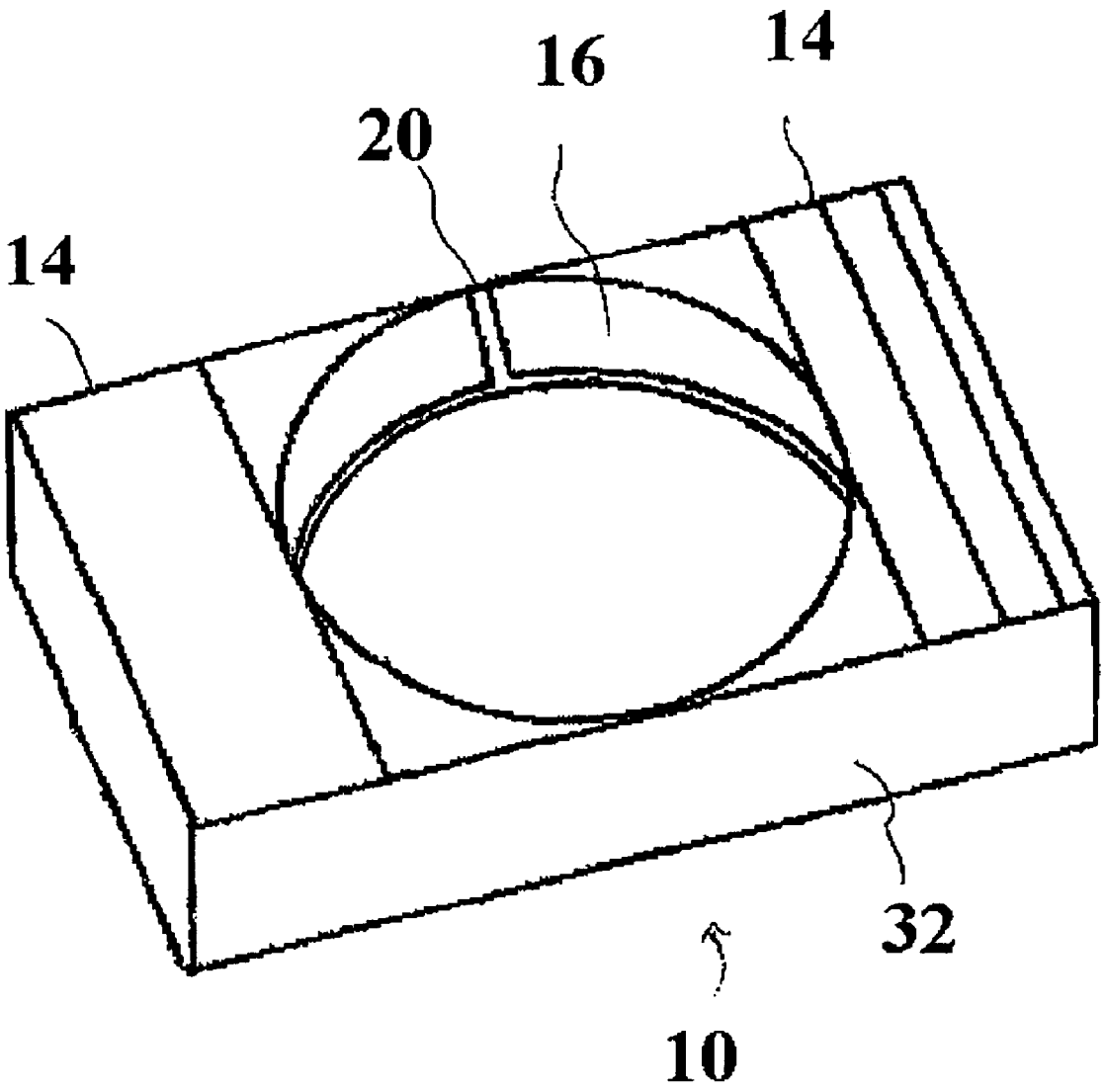
FIG. 7 is perspective view of the paint caddy of the present invention that encircles the entire paint can.

FIG. 7 is perspective view of the accessory container attachment for a paint can of the present invention that encircles the entire paint can without the paint can attached. It will be noted that this embodiment of the present invention 10, comprises of two containers 14 of generally rectangular configuration with a common arcuate side 16 thereof adapted to approximately conform and extend around the curvature of a cylindrical paint can. The primary means of attachment is slot 20. The slot is configured to engage and the handle of the paint can. A corresponding slot (not shown) is similarly positioned on arcuate side 16 so that both sides of the paint can handle are used to secure the instant invention to the paint can. It is intended that all dimensions and specifications shown in the drawings, shall be interpreted as illustrative and not in a limiting sense.

Figure 8:
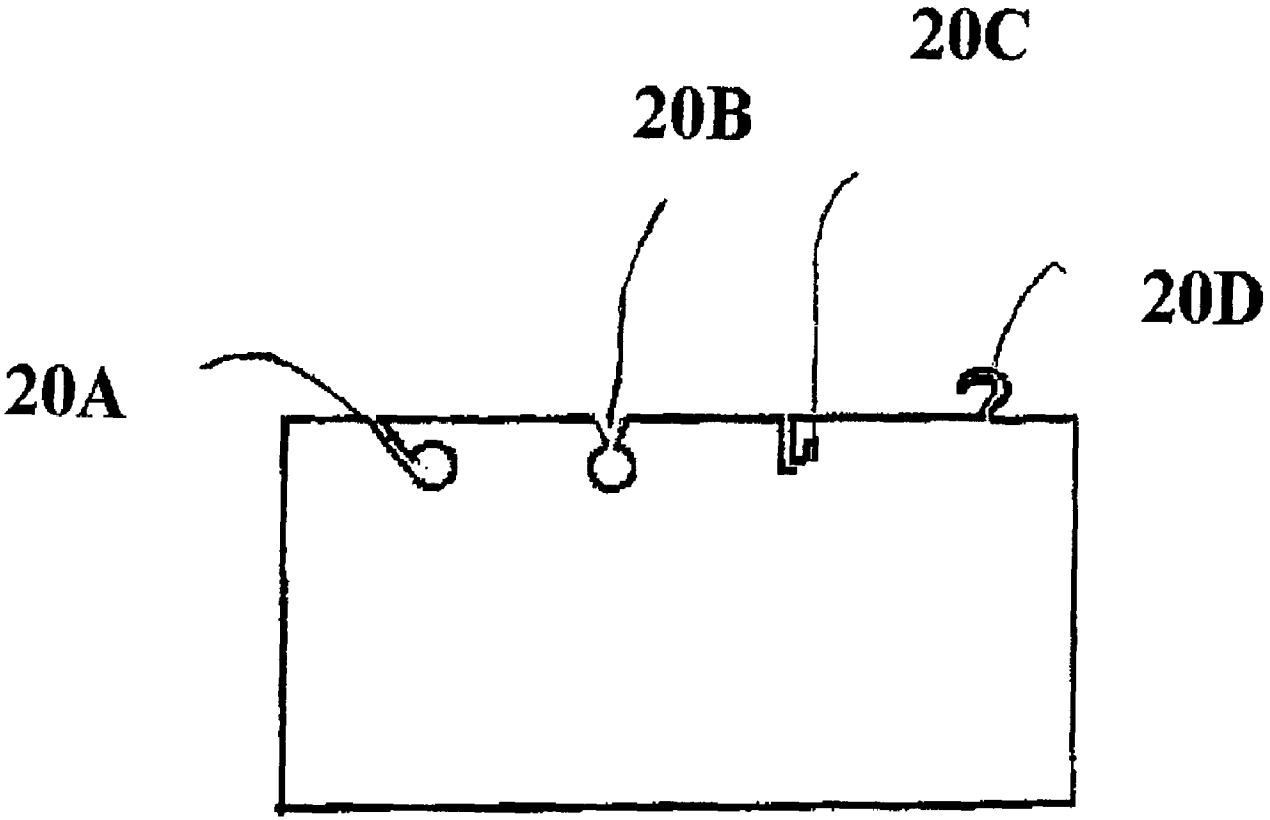
FIG. 8 is perspective view of the side panel support of the paint caddy of the present invention showing different methods of attachment.

FIG. 8 is perspective view of the side panel support of the accessory container attachment for a paint can of the present invention showing different methods of attachment. Paint can caddy is slideably removable from paint can. Means for attachment slot 20 is configured in a variety of ways. Examples of preferred embodiments of the means for attachment are labeled 20*a–d,* in FIG. 8, side slot cut out to a hole 20A, V-shaped slot cut out to a hole 20B, U shaped- slot cut out 20C and hook 20D. Again these means for attachment are examples for illustration only and should not be construed in limiting sense. Means for attachment slot 20 can comprise any means well known in the art to affix accessory container attachment for a paint can 10 to a paint can handle such as an adhesive, hook and loop fastener, or a suction cup device. It should be understood that each of the embodiments of the present invention can be made with or without a means for attachment slot 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

In General

While a preferred form of this invention has been described above and shown in the accompanying drawings, it should be understood that applicant does not intend to be limited to the particular details described above and illustrated in the accompanying drawings. In this regard, the term "means for" as used in the specification is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. An accessory container attachment for a paint can having a handle comprising:

a substantially rectangular container having one side thereof curved to conform to the curvature of said paint can, said container having at least one inner wall dividing said container into multiple compartments;

a strap secured to said container in a manner to allow said container to be removeably mounted to said paint can; and a slot in said container arranged to engage with said handle.

2. The accessory container attachment for a paint can having a handle of claim 1, wherein said strap is elastic.

3. The accessory container attachment for a paint can having a handle of claim 1, wherein said container has two inner walls dividing the container into four compartments.

4. The accessory container attachment for a paint can having a handle of claim 3 wherein at least one of said compartments is configured to hold a paint can lid.

5. The of accessory container attachment for a paint can having a handle of claim 3 wherein at least one of said compartments is configured in a substantially triangular shape.

6. The accessory container attachment for a paint can having a handle of claim 3 wherein said strap is configured with a grip.

7. The accessory container attachment for a paint can having a handle of claim 3 wherein said slot is configured as a side slot cut out to a hole.

8. The accessory container attachment for a paint can having a handle of claim 3 wherein said slot is configured as U-shaped slot cut out.

9. The accessory container attachment for a paint can having a handle of claim 3 wherein said slot is configured as a hook.

10. An accessory container attachment for a paint can comprising:

a substantially rectangular container having one side thereof curved to conform to the curvature of said paint can, said container having two inner walls dividing the container into four compartments; wherein at least one of said compartments is configured to hold a paint can lid; and wherein said paint can has a handle and the means for securing said container to said paint can is a combination of an elastic strap secured to said container in a manner to allow said container to be secured with said strap to the side of said paint can; and a slot extending downwardly through said curved side, said slot being adapted to engage with said handle.

11. The of accessory container attachment for a paint can of claim 10 wherein at least one of said compartments is configured in a substantially triangular shape.

12. The accessory container attachment for a paint can of claim 10 wherein said strap is configured with a grip.

13. The accessory container attachment for a paint can of claim 10 wherein said slot is configured as a side slot cut out to a hole.

14. The accessory container attachment for a paint can of claim 10 wherein said slot is configured as U-shaped slot cut out.

15. An accessory container attachment for a paint can comprising:

two substantially rectangular containers having one common side thereof curved to conform to the curvature of said paint can, each of said containers having two inner walls dividing each container into four compartments; wherein at least one of said compartments is configured to hold a paint can lid; and wherein said paint can has a handle and the means for securing said container to said paint can are two slots extending downwardly through said curved side, wherein said slots are arranged to engage with both sides of said handle.

* * * * *